US009700996B2

(12) United States Patent
Hansley et al.

(10) Patent No.: US 9,700,996 B2
(45) Date of Patent: Jul. 11, 2017

(54) MULTIPURPOSE TOOL FOR COMPROMISED ENVIRONMENTS

(71) Applicants: Dayana Hansley, Dyess, TX (US); Timothy Paulsen, Cedar Park, TX (US); Kiran Prasad, College Station, TX (US); Gabrielle Krzysiak, Arlington, TX (US); Andrew Michaud, Presque Isle, ME (US); McCalley Cunningham, Iola, TX (US)

(72) Inventors: Dayana Hansley, Dyess, TX (US); Timothy Paulsen, Cedar Park, TX (US); Kiran Prasad, College Station, TX (US); Gabrielle Krzysiak, Arlington, TX (US); Andrew Michaud, Presque Isle, ME (US); McCalley Cunningham, Iola, TX (US)

( * ) Notice: Subject to any disclaimer, the term of this patent is extended or adjusted under 35 U.S.C. 154(b) by 0 days.

(21) Appl. No.: 15/143,613

(22) Filed: May 1, 2016

(65) Prior Publication Data

US 2016/0243679 A1 Aug. 25, 2016

Related U.S. Application Data

(60) Provisional application No. 62/155,717, filed on May 1, 2015.

(51) Int. Cl.
*B25B 13/14* (2006.01)
*B25B 13/02* (2006.01)
(Continued)

(52) U.S. Cl.
CPC ..... *B25B 13/14* (2013.01); *B25B 13/5091* (2013.01); *B25D 1/00* (2013.01);
(Continued)

(58) Field of Classification Search
CPC ... B25F 1/00; B25F 1/003; B25F 1/04; B25D 1/00; B25B 13/14; B25B 13/5091
See application file for complete search history.

(56) References Cited

U.S. PATENT DOCUMENTS 720,168 A * 2/1903 Millea ..... B25F 1/00 7/142
1,170,138 A 5/1915 Bohne
(Continued)

FOREIGN PATENT DOCUMENTS

CN 203228205 U 10/2013

OTHER PUBLICATIONS

Justrite, Drum Bung Wrench fits many 2" or 3/4" bung styles, brass alloy, (Mar. 5, 9:48PM), www.justritemfg.com/products/drum-funnels-and-equipment/accessories-for-drum-handling/drum-cradle-lifter-wrench/08805/#sthash.Ei7otaCf.dpuf.

*Primary Examiner* — David B Thomas
(74) *Attorney, Agent, or Firm* — Texas A&M University School of Law—IP and Technology Law Clinic

(57) ABSTRACT

A multipurpose tool can include a combination of tools desirable for working with storage drums, valves, gas containers, or other items that may be present in a compromised environment. The tool can include two tool head assemblies. A feature of first tool head assembly is an adjustable wrench. Features of the second tool head assembly can include a combination of large bung wrench with a gas valve shut off. The tool can include additional tool implements that may be utilized in the compromised environment to maximize ease of use and safety of the user.

20 Claims, 13 Drawing Sheets

(51) Int. Cl.

| | |
|---|---|
| ***B25B 13/50*** | (2006.01) |
| ***B25D 1/00*** | (2006.01) |
| ***B25F 1/00*** | (2006.01) |
| ***B26B 11/00*** | (2006.01) |

(52) U.S. Cl.
CPC ..... *B25F 1/003* (2013.01); *B25F 1/006* (2013.01); *B26B 11/00* (2013.01)

(56) References Cited

U.S. PATENT DOCUMENTS 1,846,380 A 2/1932 Anderson
1,889,556 A * 11/1932 Lane ..... B25B 7/02 7/131
2,383,573 A 8/1945 Tomsek
2,445,905 A * 7/1948 Busby ..... B25B 13/02 81/124.3
2,515,558 A 7/1950 Kluth
2,528,128 A 10/1950 Forster
2,643,566 A 6/1953 Dos Santos
4,234,987 A 11/1980 Charette
4,656,895 A 4/1987 Wilson
4,680,861 A 7/1987 Meurer
4,960,016 A * 10/1990 Seals ..... B25F 1/02 7/100
5,345,636 A 9/1994 Lemons
5,440,956 A 8/1995 Johnstun
6,212,709 B1 * 4/2001 Newton ..... B25B 13/02 4/613
6,843,154 B2 * 1/2005 Webster ..... B25B 13/02 81/125.1
6,899,001 B1 5/2005 Sanders
7,334,502 B1 * 2/2008 Durkee ..... B25B 7/22 7/127
8,851,454 B1 * 10/2014 Watts ..... B25B 13/14 254/131.5
9,289,891 B1 * 3/2016 Ragner ..... B25F 1/04
2006/0156474 A1 * 7/2006 Gillingham ..... A62B 3/005 7/129
2015/0336257 A1 * 11/2015 Ragner ..... B25F 1/04 81/125.1

* cited by examiner

MULTIPURPOSE TOOL FOR COMPROMISED ENVIRONMENTS

BACKGROUND

Technical Field

The present application relates to a multipurpose tool for use on storage drums, valves, gas containers, and other obstacles in potentially compromised and hazardous environmental situations.

Description of Related Art

Storage drums, valves, and gas containers are often involved in potentially compromised environmental situations. Vehicle accidents, building collapses, and other first responder environments are also potentially compromised. Workers in these situations must be protected from the potentially compromised environment by wearing protective clothing and often using protective breathing apparatuses Many times, first responders have a limited amount of time to accomplish their tasks due to the compromised or hazardous environment. The protective clothing and weight of other gear makes it difficult for the first responder to carry in and manipulate multiple tools in a timely and efficient manner.

DESCRIPTION OF THE PREFERRED EMBODIMENT

Figure 1:
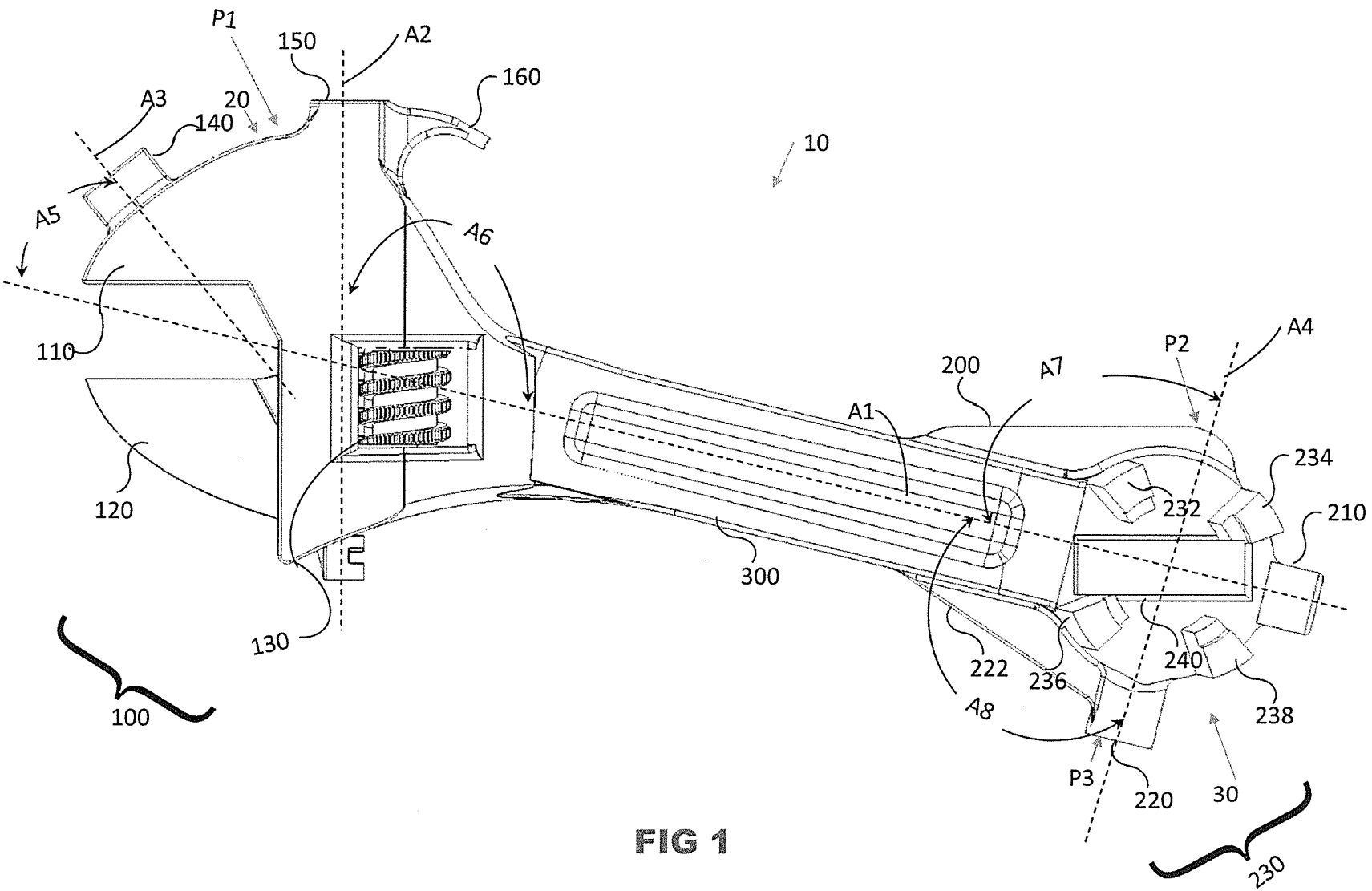
FIG. 1 is a side view of the multipurpose tool, according to one example embodiment.
Figure 2:
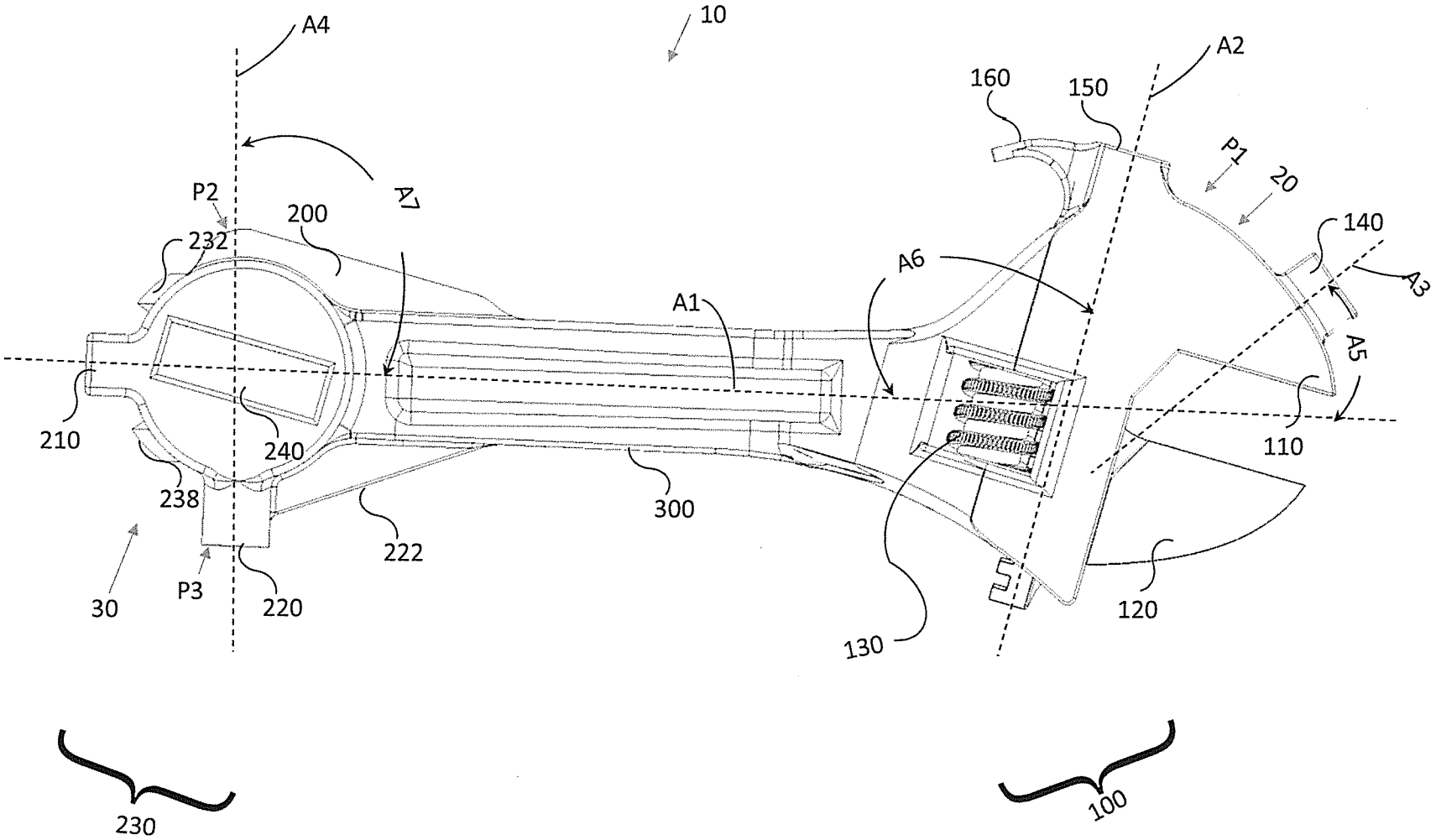
FIG. 2 is another side view of the multipurpose tool, according to one example embodiment.
Figure 3:
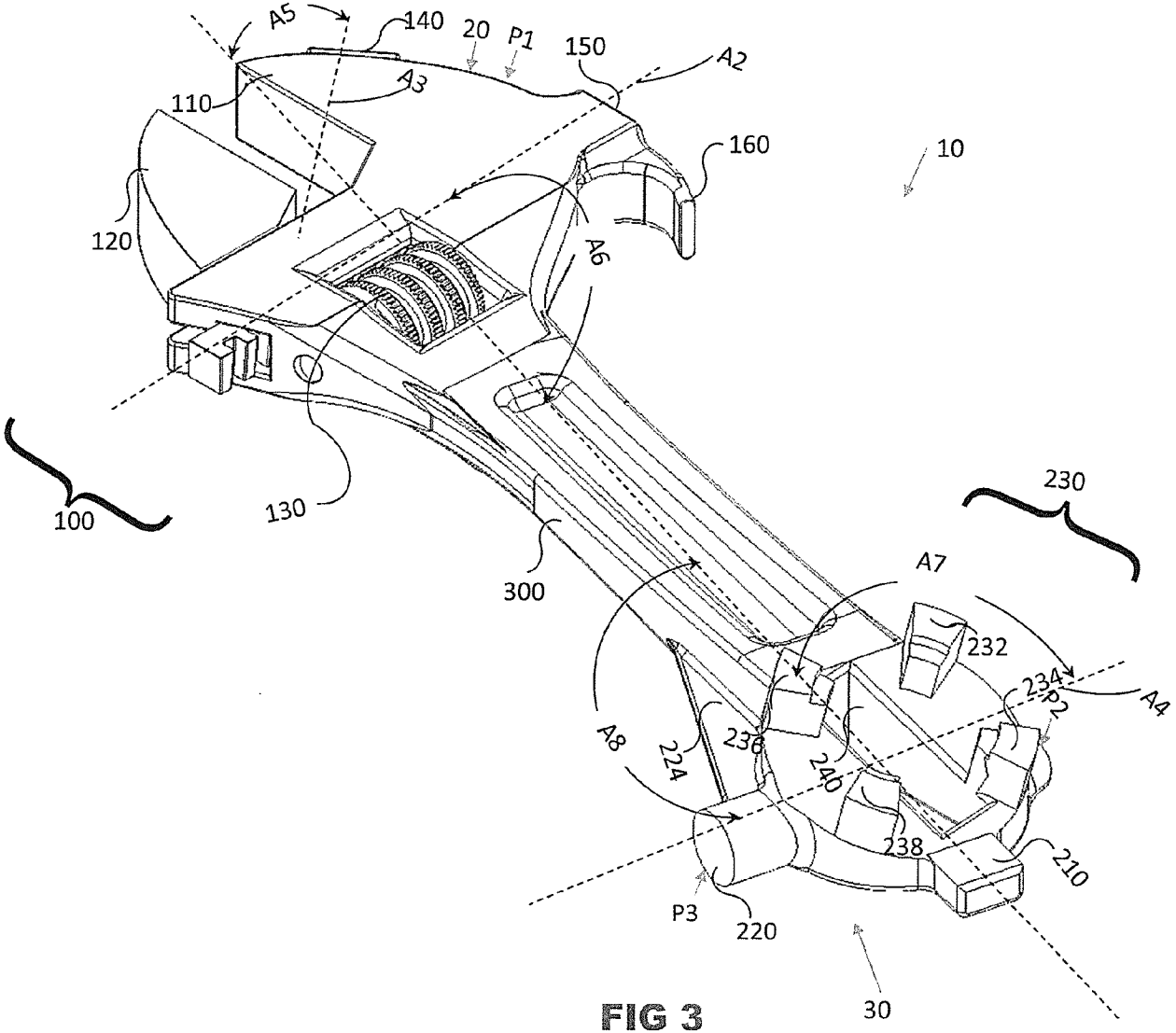
FIG. 3 is a perspective view of the multipurpose tool; according to one example embodiment.
Figure 4:
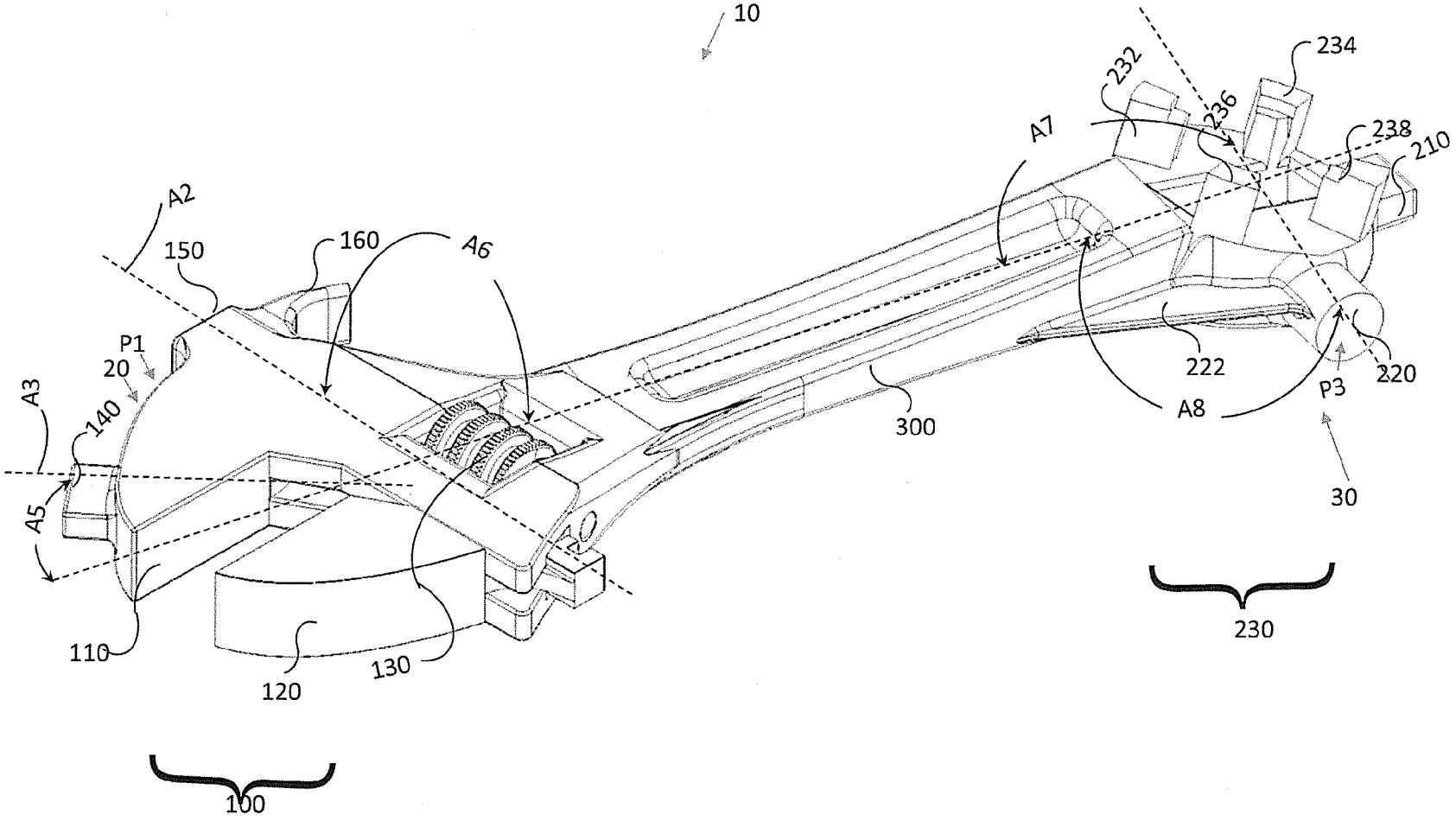
FIG. 4 is a perspective view of the multipurpose tool; according to one example embodiment.
Figure 5:
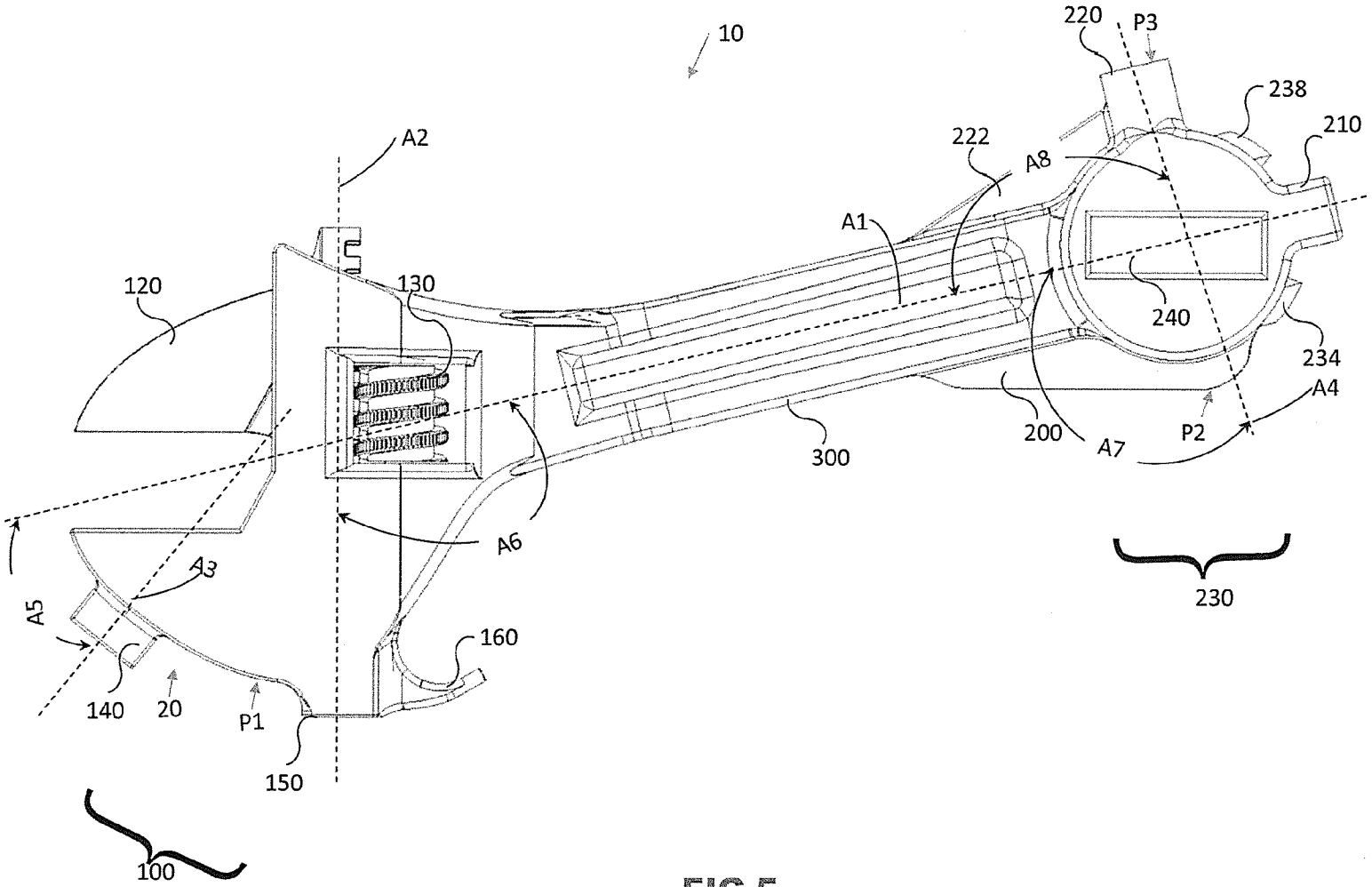
FIG. 5 is another side view of the multipurpose tool, according to one example embodiment.
Figure 6:
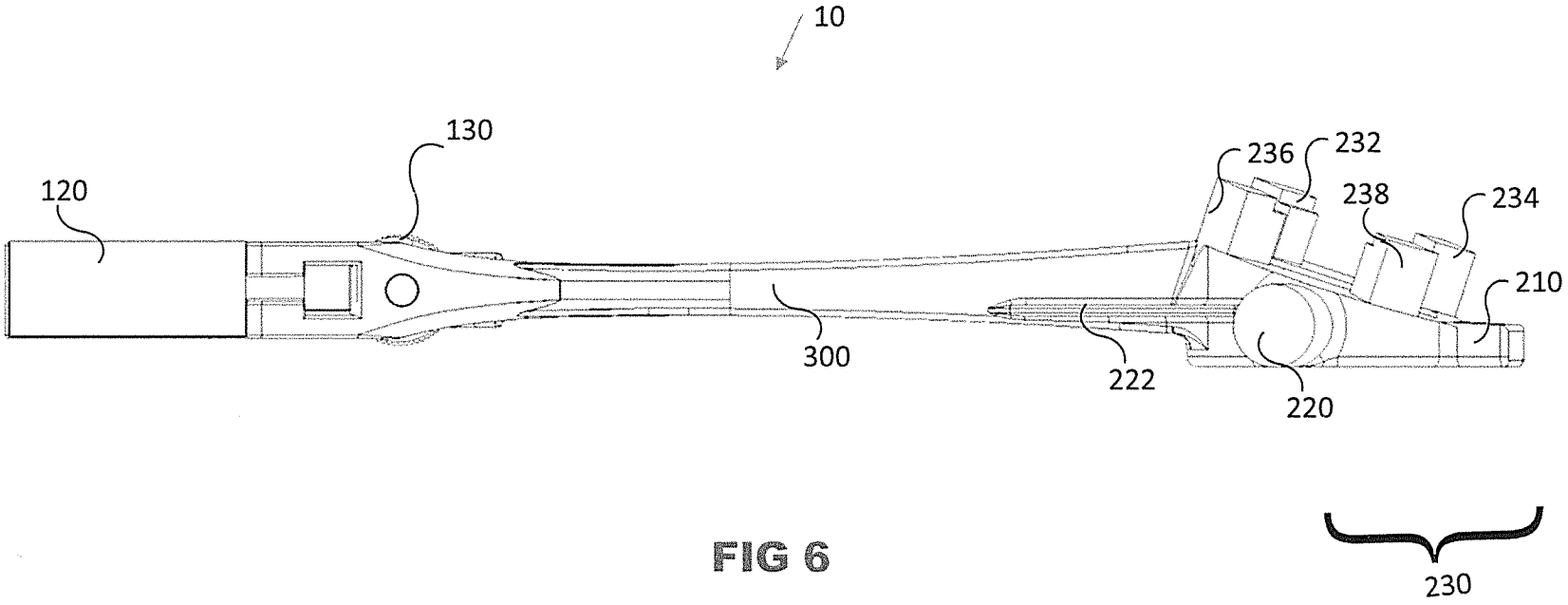
FIG. 6 is a bottom view of the multipurpose tool, according to one example embodiment.
Figure 7:
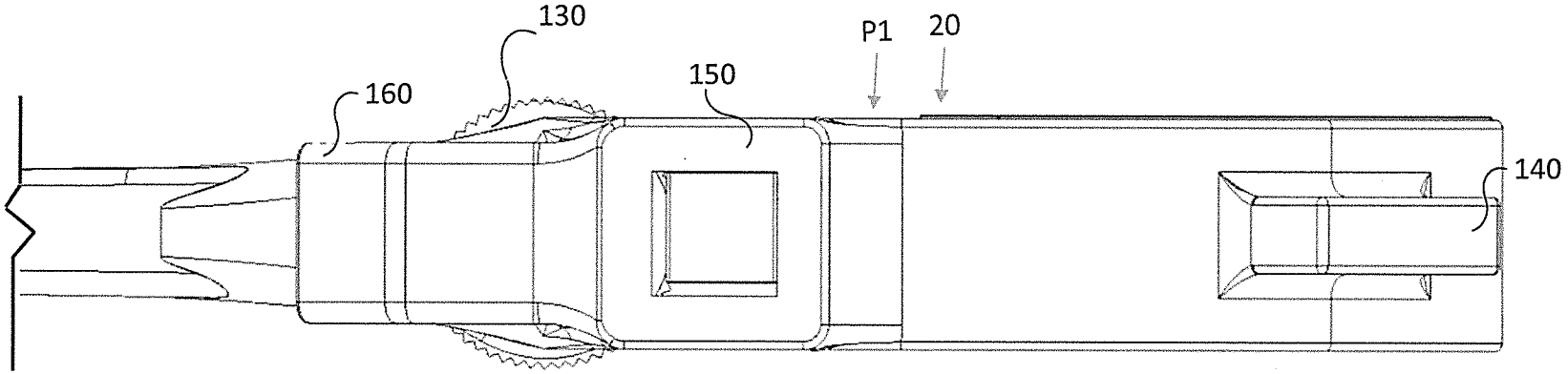
FIG. 7 is a top detail view of the first tool head portion of the multipurpose tool, according to one example embodiment.
Figure 8:
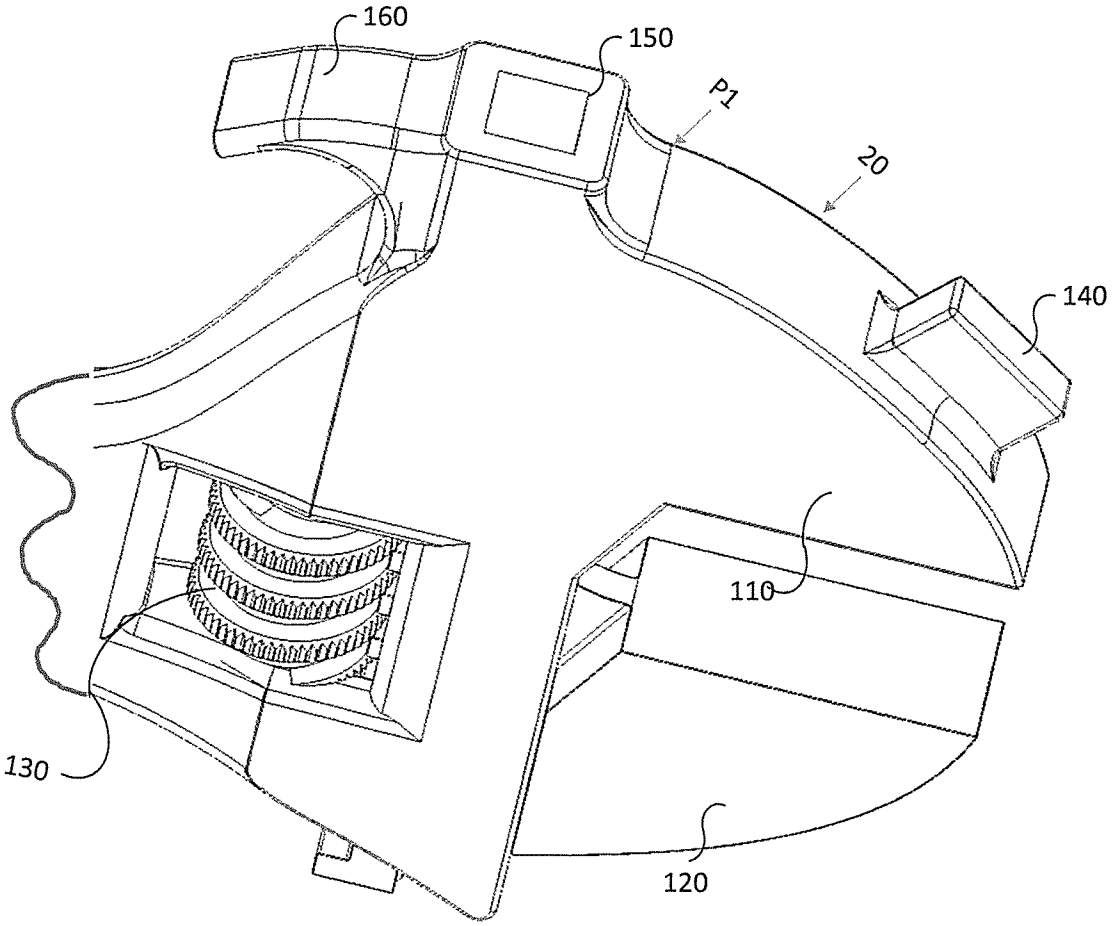
FIG. 8 is a detail perspective view of the first tool head portion of the multipurpose tool, according to one example embodiment.
Figure 9:
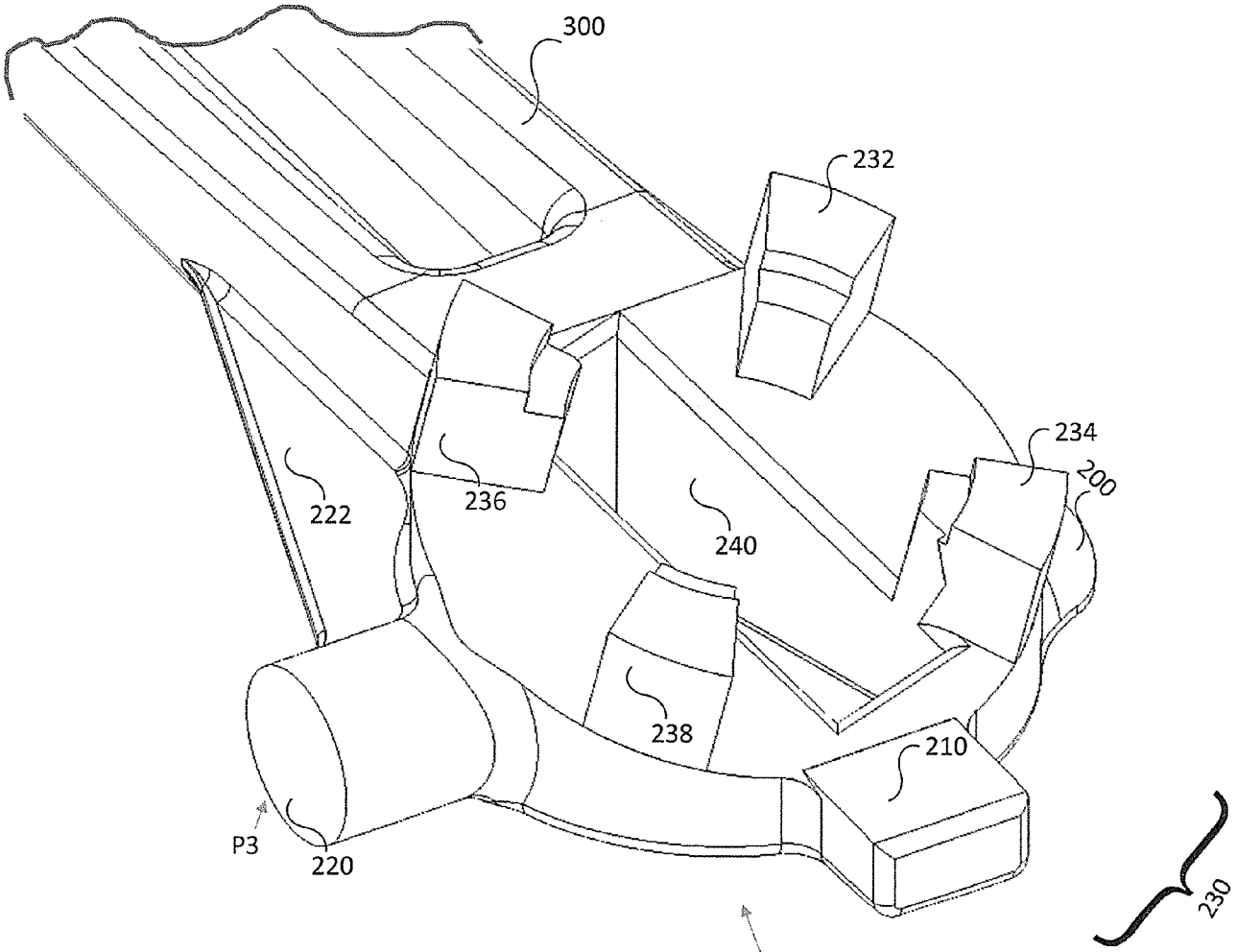
FIG. 9 is a detail perspective of the second tool head portion of the multipurpose tool, according to one example embodiment.
Figure 10:
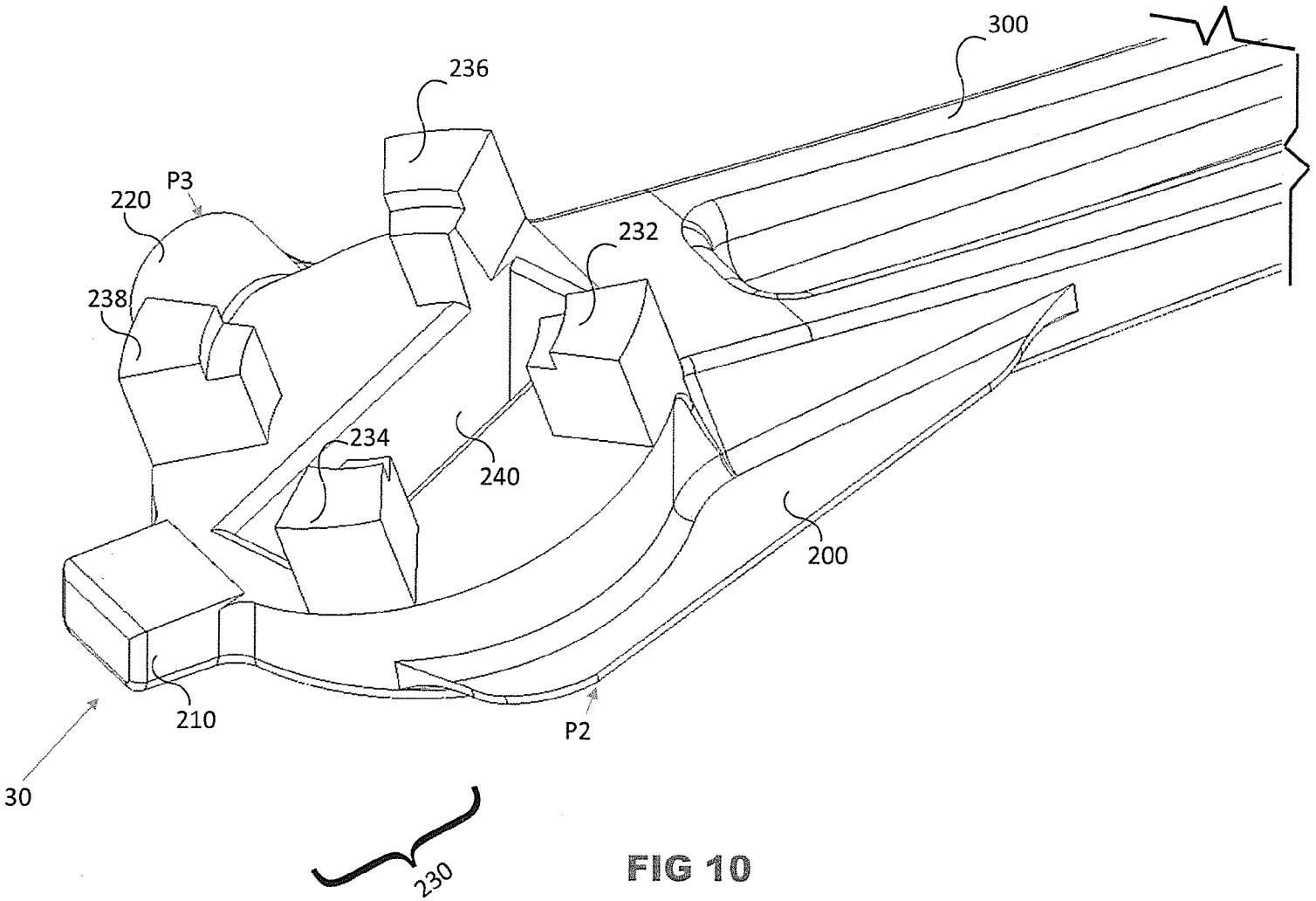
FIG. 10 is a detail perspective of the second tool head portion of the multipurpose tool, according to one example embodiment.
Figure 11:
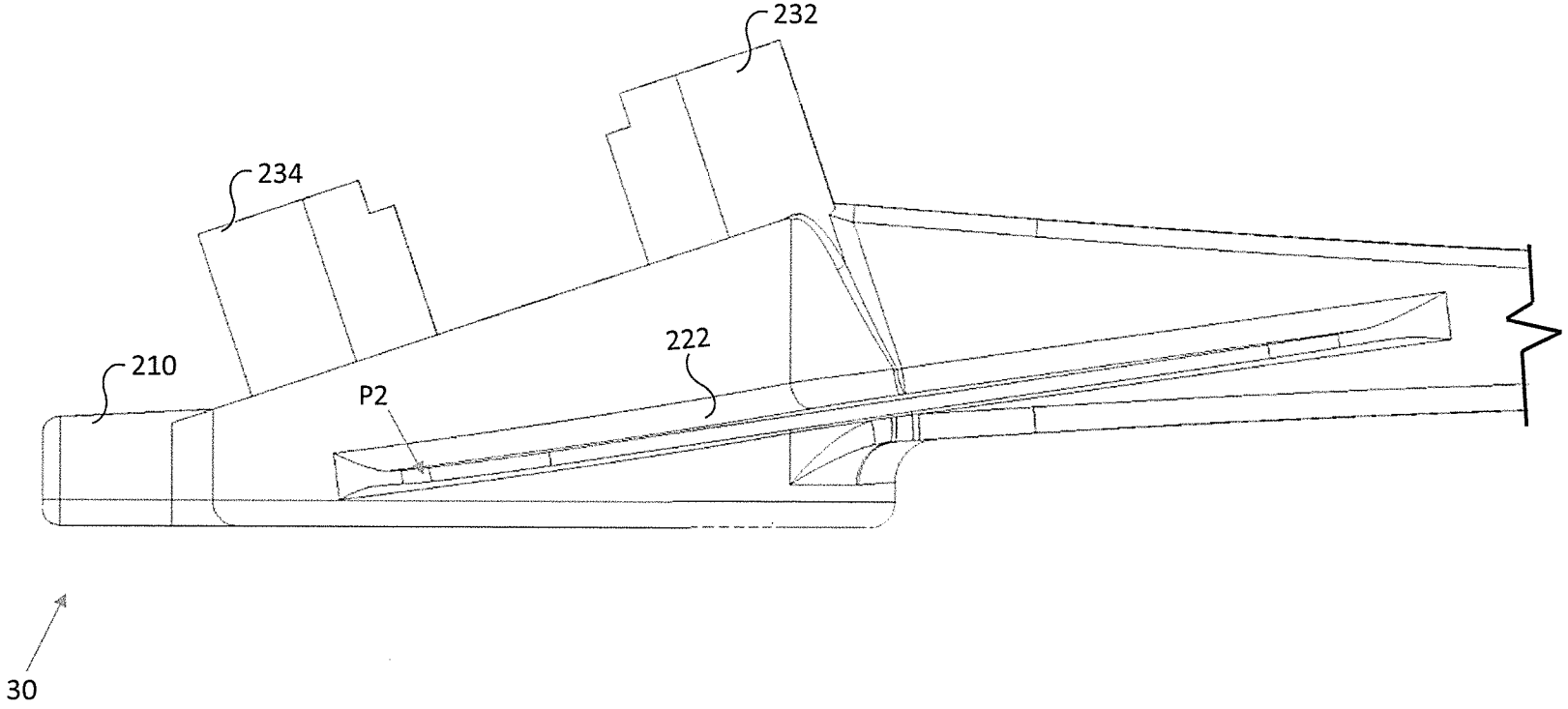
FIG. 11 is a bottom detail view of the second tool head portion of the multipurpose tool, according to one example embodiment.
Figure 12:
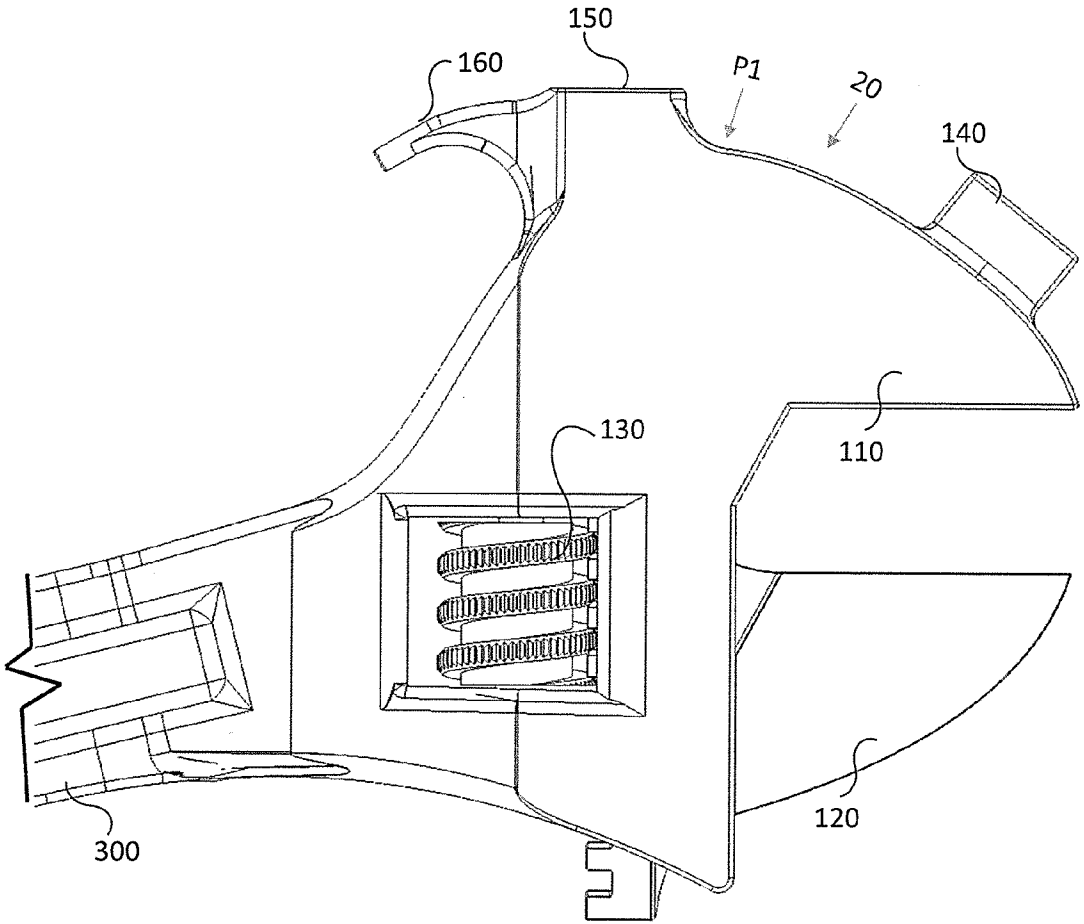
FIG. 12 is a detail side view of the first tool head portion of the multipurpose tool, according to one example embodiment.

Illustrative embodiments of the apparatus of the present application are described below. In the interest of clarity, all features of an implementation may not be described in this specification. It can be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms such as "above," "below," "upper," "lower," or other like terms to describe a spatial relationship between various components or to describe the spatial orientation of aspects of such components should be understood to describe a relative relationship between the components or a spatial orientation of aspects of such components, respectively, as the device described herein may be oriented in any desired direction.

It can be advantageous for hazardous waste workers and emergency responders to have a unique set of tools, such as: bung wrenches, an adjustable wrench, square wrenches, a hammer, and a scraper, to name a few examples. One objective of the present application is providing an apparatus that is a single tool containing a specific variety of tool implements that a worker in a potentially compromised or hazardous environmental situation may need. For example, the apparatus of the present disclosure is a multipurpose tool that can perform the functions of the most desired tools that enable working with storage drums, valves, gas containers, vehicle accidents, and other items found in potentially compromised or hazardous environmental situation. A single multipurpose tool that can allow for safety and efficiency for the worker since the worker does not have to carry an assortment. This multipurpose tool disclosed herein not only provides desired tool implements in a single tool, but also comprises a unique arrangement of the tool implements so that each tool implement can be utilized in an efficient manner.

A preferred embodiment of the tool of the present application comprises a unique combination useful tool implements, such as: a bung wrench, an adjustable wrench; a valve wrench, square wrenches, plug wrenches, a hammer, a scraper, and other tools, such as a strap cutter.

In one embodiment, one tool head assembly includes a large bung wrench, hammer, scraper, and plug wrench while at the second tool head assembly can include an adjustable wrench, a square wrench, and a smaller plug wrench. The two tool head assemblies are separated by an elongated body that provides the necessary leverage and torque to use the tool.

Referring to FIGS. 1-12, one embodiment of a multipurpose tool 10 for compromised environments is illustrated. The multipurpose tool 10 includes a first tool assembly 20 and a second tool head assembly 30, each of the first tool assembly 20 and the second tool head assembly 30 secured together by an elongated shaft 300. A longitudinal axis A1 extends through the elongated shaft 300 through the first tool head assembly 20 and the second tool head assembly 30. In the illustrative embodiment, an axis A2 extends through the square wrench 150 intersecting the longitudinal axis A1. An axis A3 extends through a high torque bung wrench 140 that intersects the longitudinal axis A1. The axis A4 extends through a hammer 220 and a hammer balance 222 in this embodiment intersects the main longitudinal axis A1.

The first tool head assembly 20 main component is an adjustable wrench 100. The adjustable wrench 100 is comprised of three main components; a stationary piece 110, a movable piece 120, and a worm gear 130. An adjustable opening between the stationary piece 110 and the moveable piece 120 can be selectively secured to a head of a fastener for removing or installed the fastener. A user's hand can hold the multipurpose tool 10 at the second tool head assembly 30 when utilizing the adjustable wrench 100.

In the example embodiment, a ¾ inch plug wrench 140 is attached to the stationary piece 110 of the adjustable wrench 100. The ¾ inch plug wrench 140 is positioned at an end portion of the stationary piece 110 at an angle A5, which allows the user to maximize the torque by the application of force through the length of the elongated shaft 300 to open hazardous waste drums or other containers with the ¾" fitting. In the illustrated embodiment, the angle A5 of the ¾ inch plug wrench 140 is approximately 45 degrees as measured from the axis A1; however, it should be appreciated that the high ¾ inch plug wrench 140 can be located at other implementation specific angles. One advantage of locating the ¾ inch plug wrench 140 on the stationary piece 110 of the adjustable wrench is that the stationary piece 110 is more structurally rigid compared to the movable piece 120 of the adjustable wrench 100.

In this embodiment, a ⅜ inch square wrench 150 placed at an angle A6 to allow the user to maximize the torque by the application of force through the length of the elongated shaft 300. The ⅜ inch square wrench 150, in this embodiment, is a square with a square aperture. In another embodiment, the ⅜ inch square wrench 150 may have a different outer shape with a square aperture and the thickness of walls may vary. In the illustrated embodiment, the ⅜ inch square wrench 150 is located near an apex portion P1 to provide clearance for a user hand when the user's hand attached to the other end of the multipurpose tool 10. For example, when the user needs as much torque as possible, the user's hand can be coupled to the second tool head assembly 30. In such a situation, having the ⅜ inch square wrench 150 extending from the apex portion P1 can provide an increased amount of clearance between the user's hand and an object, such as a drum container. Furthermore, it is preferred that the angle A6 is at orientation larger than 90°, as measured from axis A1, so as to increase clearance of the user's hand to an object when the ⅜ inch square wrench 150 is engaged to open or close a gas canister. For example, the angle A6 can be approximately 110°; however, it should be appreciated that other embodiment can include other angles.

In this embodiment, a spanner wrench 160 placed near the ⅜ inch square wrench 150 to allow the user to maximize the torque by the application of force through the length of the elongated shaft 300. The spanner wrench 160, in this embodiment, is a positioned to maximize leverage while in use. For example, when the user needs as much leverage as possible, the user's hand can be coupled to the second tool head assembly 30. In such a situation, having the spanner wrench 160 extending from the ⅜ inch square wrench can provide an increased amount of clearance between the user's hand and an object, such as a fire hydrant.

The second tool head assembly 30 can include a large bung wrench 230 having four individual bung wrench prongs 232, 234, 236, and 238 collectively configured for opening a 2 inch bung plug. Each bung wrench prong 232, 234, 236, and 238 extends at an angle to provide clearance from the planar surface of the elongated shaft 300 when the large bung wrench 230 is in use. Each bung wrench prong 232, 234, 236, and 238 can include a tool feature and be located in a selected pattern that mates with a bung plug. The large bung wrench 230 is located a selected distance from axis Al in order to provide clearance between the multipurpose tool 10 and an object when the large bung wrench 230 is being used by a user. A gas valve shut off 240 is located on the opposite side of the large bung wrench 230. The orientation of the large bung wrench 230 and the gas valve shut off 240 is in a direction normal to a planar surface of the elongated shaft 300, which allows the user to hold onto the first tool head assembly 20 while working with either the large bung wrench 230 or the gas valve shut off 240.

Another ¾ inch plug wrench 210 is located along the main longitudinal axis A1 at the tip of the second tool head assembly 30 in order to take advantage of the full length of the multipurpose tool 10 and allow the user to add their body mass for additional leverage to help remove the plug from the drum. A differentiation between the ¾ inch plug wrench 210 and the ¾ inch plug wrench 140, other than location on the tool, is that the ¾ inch plug wrench 210 extends further out from the second tool head assembly 30 than the high torque bung wrench 140 extends out from the first tool head assembly 20. This differentiation allows the user to move quicker with the ¾ inch plug wrench 210, while the ¾ inch plug wrench 140 allows for more torque to be applied.

The second tool head assembly 30 can include a scraper 200. An apex portion P2 of scraper 200 is located on axis A4 at an angle A7 to axis A1. In the illustrated embodiment, an apex portion P2 of scraper 200 is opposite from a hammer 220 also located on axis A4. Axis a4, which is central to a hammer face P3 of hammer 220 is at an angle A8 to axis A1. In this embodiment, the hammer 220 has a rounded shape, but in other embodiments, the hammer 220 may have a square, oblong, or other implementation specific shape. A hammer stiffener 222 located on the second tool head assembly 30, which is smaller than the first tool head assembly 20, provides stability to the hammer 220 during operation. The hammer 220 is selectively located on the second tool head assembly 30 because since the second tool head assembly does not contain any moving parts. The alternative of placing the hammer 220 on the first tool head assembly 20 is disfavored as the force from hammering may damage either the worm gear 130 or the movable piece 120 of the adjustable wrench 100. Furthermore, it is preferred that the angles A7 and A8 are 90°, as measured from axis A1 and illustrated in the example embodiment in FIG. 1; however, it should be appreciated that other embodiments can include other angles.

In one embodiment, the main component for the first tool head assembly 20 is an adjustable wrench 100 because the adjustable wrench 100 is heavier than the main component for the second tool head assembly 30, which is a large bung wrench 230. The heaviest tool components, the scraper 200 and the hammer 220, are located on the second tool head assembly 30 in order to improve overall the balance of the tool 10. The hammer 220 is located such that the hammer 220 extends along axis A4 in a direction opposite from the stationary piece of the adjustable wrench 110, to stabilize the tool since the hammer 220 and the adjustable wrench 110 can be the heaviest components of tool 10.

In the illustrated embodiment, the ⅜ inch square wrench 150, ¾ inch plug wrench 140, spanner wrench 160, scraper 200, 3/4 inch plug wrench 210, and the hammer 220 are strategically located to prevent interference to other tool components and to prevent inadvertent damage or injury to the user and surroundings; however, it should be appreciated that other embodiments may have other orientations that achieve a similar function.

Figure 13:
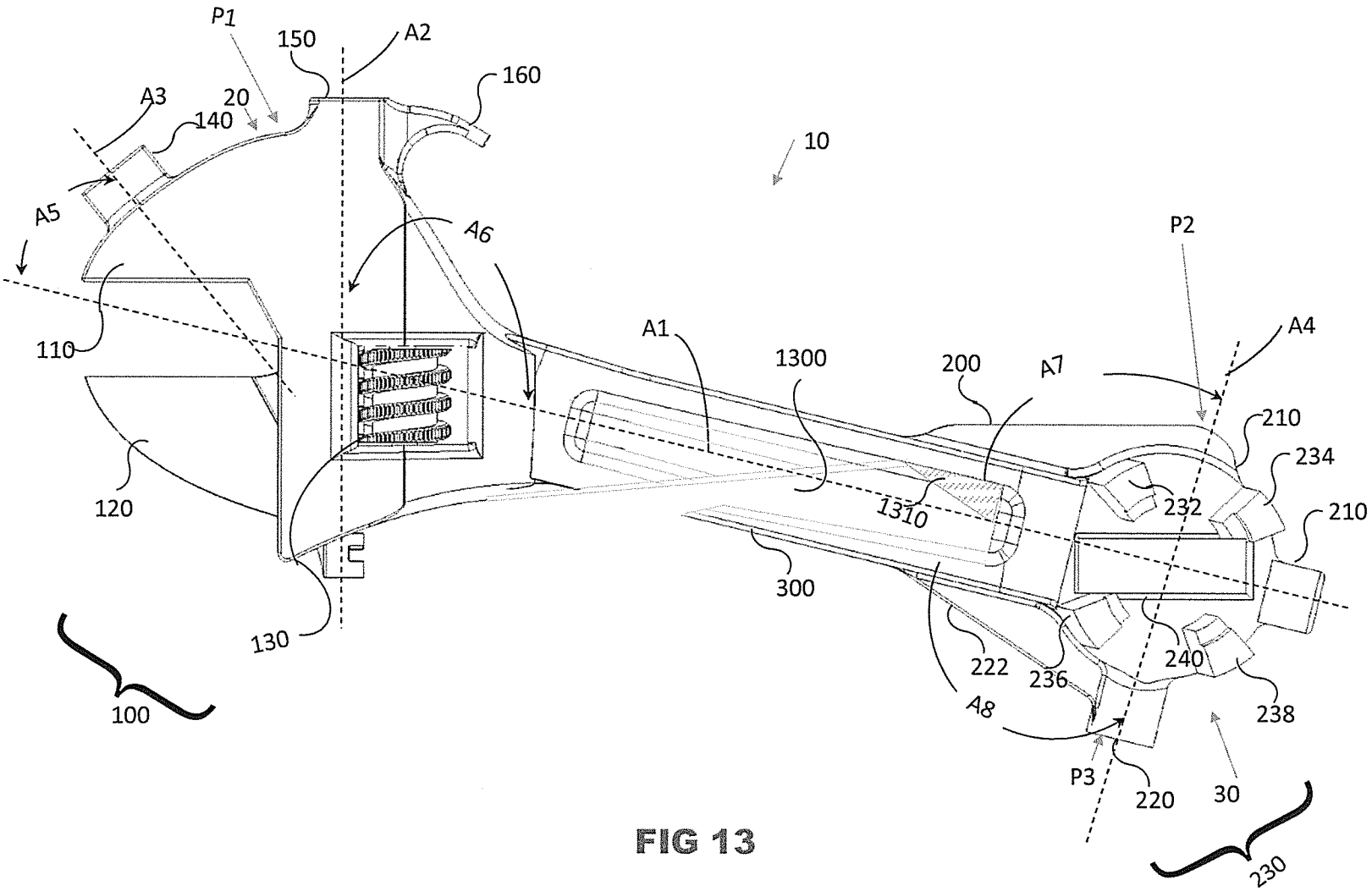
FIG. 13 is a side view of the multipurpose tool, according to one example embodiment.

Referring to FIG. 13, another embodiment of a multipurpose tool 10 for compromised environments is illustrated. The multipurpose tool 10 of FIG. 13 includes embodiment of FIGS. 1-12 with the addition of a strap cutter 1300 to the elongated shaft 300. Strap cutter 1300 can be included on the elongated shaft 300. The illustrated strap cutter 1300 includes a small blade 1310 partially protected from inadvertent contact by a portion of the elongated shaft 300. The strap cutter 1300 can be used by emergency responders to cut seat belt straps, by workers to cut drum straps, or by workers to cut any other straps present in the compromised environment.

The limited amount of time workers have to accomplish their tasks due to the compromised or hazardous environment creates a need for an efficient, portable tool. The protective clothing and weight of other gear makes it difficult for the worker to carry in and manipulate multiple tools in a timely and efficient manner. The embodiments of the present application satisfies a considerable need by allowing ease of use and speed that is necessary in the typical environments for which the multipurpose tool could be used. The mass balance of the tool and strategic placement of components allow for maximum efficiency and speed.

The particular embodiments disclosed above are illustrative only, as the apparatus may be modified and practiced in different but equivalent manners apparent to those skilled in the art having the benefit of the teachings herein. Modifications, additions, or omissions may be made to the apparatuses described herein without departing from the scope of the invention. The components of the apparatus may be integrated or separated. Moreover, the operations of the apparatus may be performed by more, fewer, or other components.

Furthermore, no limitations are intended to the details of construction or design herein shown, other than as described in the claims below. It is therefore evident that the particular embodiments disclosed above may be altered or modified and all such variations are considered within the scope and spirit of the application. Accordingly, the protection sought herein is as set forth in the claims below.

The invention claimed is:

1. A multipurpose tool, capable of being manipulated by a user, the multipurpose tool comprising:
- a first tool head assembly comprising:
  - an adjustable wrench having a stationary piece;
  - a square wrench located on the stationary piece;
  - a first plug wrench; and
  - a spanner wrench located on the stationary piece adjacent to the square wrench;
- a second tool head assembly comprising:
  - a bung wrench;
- an elongated shaft rigidly coupling the first tool head assembly and the second tool head assembly.

2. The multipurpose tool according to claim 1, the adjustable wrench comprising:
- a moveable piece; and
- a worm gear.

3. The multipurpose tool according to claim 1, wherein the second tool head assembly further comprises:
- a gas valve shut off;
- a second plug wrench;
- a hammer; and
- a scraper.

4. The multipurpose tool according to claim 3, further comprising:
- a hammer stiffener extending between the hammer and the elongated shaft.

5. The multipurpose tool according to claim 3, wherein the second plug wrench is located and centered on a longitudinal axis of the elongated shaft.

6. The multipurpose tool according to claim 3, wherein the scraper has an apex that is located on a side of the second tool head assembly that is opposite the hammer.

7. The multipurpose tool according to claim 1, wherein the first plug wrench is a rectangular extension of an outer surface of a fixed portion of the adjustable wrench.

8. The multipurpose tool according to claim 1, wherein the bung wrench includes four bung wrench plugs.

9. The multipurpose tool according to claim 1, wherein the square wrench is a ⅜ inch square wrench.

10. The multipurpose tool according to claim 1, wherein a center portion of the elongated shaft includes of a cutting tool configured for the cutting of a strap of material.

11. The multipurpose tool of claim 10, wherein the cutting tool is recessed in an opening to limit contact with a blade portion of the cutting tool.

12. A multipurpose tool, capable of being manipulated by a user, the multipurpose tool comprising:
- a first tool head assembly comprising:
  - an adjustable wrench;
- a second tool head assembly comprising:
  - a bung wrench;
- an elongated shaft rigidly coupling the first tool head assembly and the second tool head assembly;
- wherein the elongated shaft is in the shape of an I-beam.

13. The multipurpose tool according to claim 12, wherein the second tool head assembly further comprises:
- a gas valve shut off;
- a second plug wrench;
- a hammer; and
- a scraper.

14. The multipurpose tool according to claim 12, wherein the first tool head assembly further comprises:
- a square wrench located on the stationary piece;
- a first plug wrench; and
- a spanner wrench located on the stationary piece adjacent to the square wrench.

15. The multipurpose tool according to claim 12, wherein the bung wrench includes four bung wrench plugs.

16. The multipurpose tool according to claim 12, further comprising:
- a hammer.

17. The multipurpose tool according to claim 16, further comprising:
- a hammer stiffener extending between the hammer and the elongated shaft.

18. A multipurpose tool, capable of being manipulated by a user, the multipurpose tool comprising:
- a first tool head assembly comprising:
  - an adjustable wrench;
- a second tool head assembly comprising:
  - a bung wrench;
- an elongated shaft rigidly coupling the first tool head assembly and the second tool head assembly;
- a gas valve shut off; wherein the gas valve shut off is a rectangular shaped opening between a frontside and a backside of the second tool head assembly.

19. The multipurpose tool according to claim 18, further comprising:
- a hammer.

20. The multipurpose tool according to claim 18, the adjustable wrench comprising:

a stationary piece;

a moveable piece; and a worm gear.

* * * * *